US005152226A

United States Patent [19]

Swilley

[11] Patent Number: 5,152,226

[45] Date of Patent: Oct. 6, 1992

[54] TRACK SWITCH WITH DUAL SHAFT PIVOT AND ROTATABLE HUB CONNECTED TO SWITCH COMPONENTS AND MOUNTED ON AN OUTER PIVOT SHAFT HAVING A GREATER PRESET LENGTH

[75] Inventor: Wilson H. Swilley, Persia, Iowa

[73] Assignee: Bond Equipment Corp., Logan, Iowa

[21] Appl. No.: 705,311

[22] Filed: May 24, 1991

[51] Int. Cl.[5] ..... E01B 25/26

[52] U.S. Cl. ..... 104/100; 403/156; 403/161; 403/163; 104/130

[58] Field of Search ..... 104/96, 100, 130; 403/154, 156, 157, 158, 161, 162, 163

[56] References Cited

U.S. PATENT DOCUMENTS

| | | | |
|---|---|---|---|
| 2,746,397 | 5/1956 | Le Fiell | 104/101 |
| 2,901,276 | 8/1959 | Nolden et al. | 403/156 X |
| 3,739,727 | 6/1973 | Bedford | 104/130 X |
| 3,818,836 | 6/1974 | Swilley | 104/100 |
| 4,435,100 | 3/1984 | Cox | 403/161 X |
| 4,453,469 | 6/1984 | Bedford | 104/100 |
| 4,646,646 | 3/1987 | Swilley | 104/100 |

*Primary Examiner*—Robert J. Oberleitner
*Assistant Examiner*—S. Joseph Morano
*Attorney, Agent, or Firm*—Lloyd L. Zickert

[57] ABSTRACT

An improved switch for an overhead trolley track system, which is adaptable to be inserted between intersecting tracks and adjustable for handling trolley movement from one track to another. The improved switch includes a unique pivot and shaft assembly whereby the hub member attached to the track lift piece rotates or pivots freely about an outer shaft without applying force to an inner shaft mounted to the track, thereby avoiding constant maintenance, malfunctions, and system interruption.

11 Claims, 1 Drawing Sheet

TRACK SWITCH WITH DUAL SHAFT PIVOT AND ROTATABLE HUB CONNECTED TO SWITCH COMPONENTS AND MOUNTED ON AN OUTER PIVOT SHAFT HAVING A GREATER PRESET LENGTH

This invention relates in general to an improved switch for an overhead trolley track, and more particularly to a pivot and shaft means for a track segment or lift piece providing reduced maintenance and better overall operation of the overhead trolley track system.

BACKGROUND OF THE INVENTION

Heretofore, it has been well known to provide switches for overhead track systems along which trolleys are either manually or power driven and particularly for the movement of goods suspended from the track by the trolleys between stations for processing or for storing goods. For example, overhead conveyors having tracks and switches in the tracks are commonly used in warehouse operations and also in meat-processing plants. Exemplary of the type of mechanisms heretofore known are disclosed in U.S. Pat. Nos. 2,746,397, 3,818,836, and 4,646,646. These switches include a plurality of levers and links arranged between lifting track sections, the position of which control the movement of trolleys along intersecting tracks or rails. It is also known, as shown in these patents, to automatically allow the movement of a trolley through the switch in one direction without manually or otherwise adjusting the switch. Movement in the opposite direction is controlled by adjustment of the switch.

The heretofore known switches have included a shaft about which the track lift pieces are connected to the switch linkage pieces. This connection which directly rotates about the shaft has caused considerable problems including overtightening of the shaft prohibiting free rotation, loosening of the shaft causing misalignment of the lift piece with the track, and undertightening of the shaft also leading to misalignment of the lift piece with the track. Overall the shafts heretofore used in overhead track systems have needed considerable and costly maintenance, have been difficult to service in the field, and have caused considerable difficulties in system operation. For example, improper seating or alignment of a lift piece may cause trolley derailment, trolley and/or track damage, damage to goods carried by the trolleys, and sometimes injury to persons working underneath the track or rail.

SUMMARY OF THE INVENTION

The present invention overcomes the problems heretofore known and provides a pivot and shaft means for a switch for overhead track systems that is easily installed to the proper tension, which remains at that proper tension, which does not loosen, which needs little maintenance, and thus causes little, if any, system operational difficulties.

It is therefore an object of the present invention to provide a new and improved switch for an overhead track system which is easily installed, needs little if any adjustment, and is thus virtually maintenance-free.

Another object of the present invention is to provide a new and improved switch for an overhead track system that is easily adjusted to the proper position, does not loosen with the operation of the system, and is easily serviced in the field.

A further object of the invention is in the provision of an improved track switch having a track segment or section pivot that can be easily maintained and tensioned for substantially maintenance-free operation.

Other objects, features and advantages of the invention will be apparent from the following detailed disclosure, taken in conjunction with the accompanying sheet of drawings, wherein like reference numerals refer to like parts.

DESCRIPTION OF THE INVENTION

Figure 1:
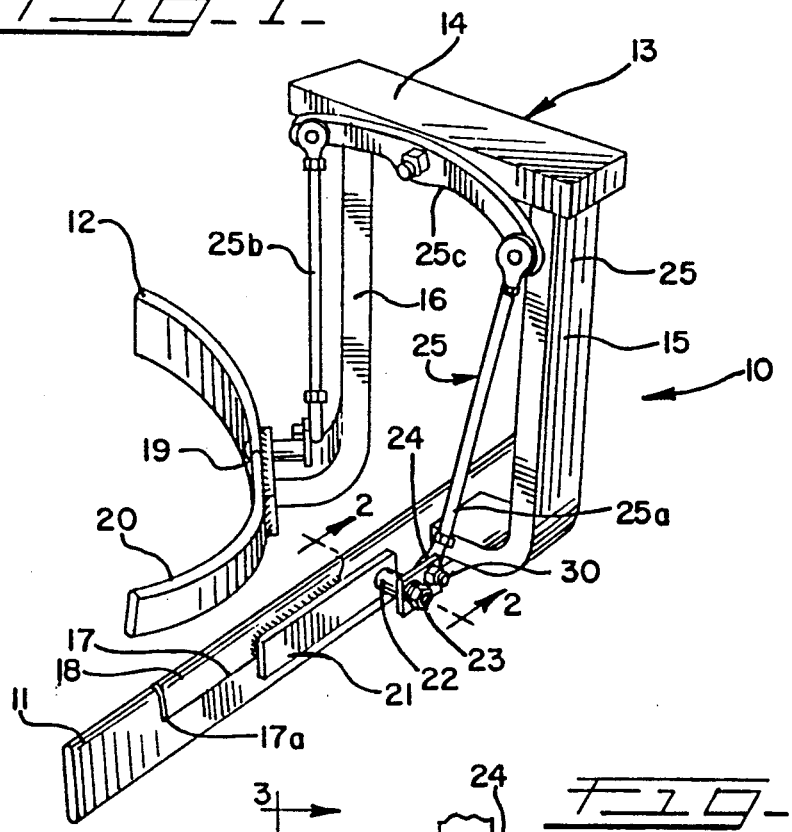
FIG. 1 is a perspective view of a switch for an overhead track layout looking from above with the lift section or piece of the main track in down position and the lift section of the curved track in an up position and including the improved pivot and shaft assembly of the present invention.

The track switch of the present invention is primarily useful for overhead conveyor systems installed for the purpose of transporting and moving goods between stations or locations. Particularly, such a conveyor system serves to movably support trolleys along flat bar or round bar tracks or rails. The trolleys generally include a single wheel or roller supporting a bracket and suitable means for attaching thereto the goods to be moved along and within the track or conveyor system. The trolleys may be power driven or manually driven. A track layout may include one or more main tracks and any number of auxiliary tracks. Normally, work stations will be situated along the main tracks although they may likewise be situated along an auxiliary track. Storage areas may also be associated with auxiliary tracks. The track switch of the invention is intended to assist in controlling the movement of the trolleys between intersecting tracks. The intersecting tracks would be arranged to have the track switch positioned to allow movement of the trolleys therebetween in whatever desired direction. Normally, the intersecting tracks are at right angles to each other but they may also be angularly related to each other.

The track switch of the invention may include a combination of straight and curved sections or curved and curved sections. Where straight and curved sections are used, the curved section may come in from either side, and either the straight or curved section may be considered to be the main track. Where curved and curved sections are provided, either of the curved sections may be considered the main track. Track lift pieces or segments or sections are provided for each of the track members in the switch and are selectively movable between a non-trolley engageable raised position and a trolley engageable seated position for purposes of allowing trolley movement through the track on one or the other of the track members. A transmission device is provided to control the position of the lift pieces such that only one lift piece is in trolley engageable seated position at any one time. Further, the transmission system permits automatic movement of a trolley through the switch from either of the track members in one direction whether or not the lift pieces of whichever member the trolley is movable along is in the trolley engageable or non-trolley engageable position. If a lift piece is in non-trolley engageable position, the trolley engages the lift piece and forces it into seated position and at the same time through the transmission system forces the other lift piece into non-engageable position.

It is the pivot and shaft means of the switch that is unique in the present invention in that it utilizes a hub member which rotates or pivots about an outer shaft or sleeve longer than the hub member and which is secured to the track by a fastening means on a yet longer inner or center shaft. Thus, free pivot movement of the hub member is provided about the outer shaft or sleeve without the rotational movement or force of the hub member on the inner or center shaft, which results in an easily adjusted shaft means that needs little, if any, maintenance.

Referring now to the drawings, and particularly to the embodiment disclosed in FIG. 1, the track switch 10 of the invention is illustrated in a form hereinafter referred to generally as a straight and curved unit and where the curved track member comes into the main track from the left. It may be readily appreciated that the curved track member may come in from the right or opposite side where so desired or needed in a track layout. The track switch is installable in an overhead conveyer track system suspended from the ceiling and situated between intersecting tracks. The switch is illustrated as being mounted between a main or straight track or rail 11 and a curved or auxiliary track or rail 12. The track is of the flat bar configuration, although it will be appreciated that the present invention may be utilized in track layouts having track of the round bar configuration.

Movable along the tracks are trolleys of the usual type including a roller or wheel, and bracket means suspended from the wheel and for supporting a goods-engaging member such as shown in U.S. Pat. No. 4,646,646; and for purposes of illustrating the use of the track switch of the invention, that part of the disclosure in the '646 patent is incorporated herein.

The track switch 10 is interconnected by a bridge 13 extending above the track members but being of a height to clear the ceiling. The bridge 13 includes an overhead crossbar 14, a downwardly extending leg 15 inwardly turned at its lower end and suitably connected to the straight track member 11, and a downwardly extending leg 16 with an inwardly extending portion at its lower end that is suitably connected to the curved track member 12. Thus, the bridge 13 supports and maintains the relationship between the straight and curved track members.

The straight track member 11 includes a cutout portion 17 along its upper trolley engaging portion for selectively receiving in seated position therewith a straight lift piece 18 formed to mate with the cutout portion 17. Guide members **17*a* are provided on the track to guide the lift pieces to proper seated position. The curved track member 12 terminates short of the straight track member 11 to allow movement of a trolley thereby along the straight track member and is provided with a notch 19 at its end adjacent the straight track member which mates with inner end of a curved lift piece 20 when the curved lift piece is in seated position and forming a connection with the straight track member 11. The free end of the curved lift piece seats on the straight track member at the forward end of cutout portion 17, and it is guided to a proper seating position by guide members 17*a***.

The straight lift piece 18 is secured to an actuating arm 21 that is in turn secured to a tubular hub member 22 situated at one side of the straight track member 11 and pivotally mounted on a shaft means 23 which is supported on the straight track member 11. A crank arm 24 is secured to the tubular hub member 22 on the opposite side of the actuating arm 21, and the crank arm 24 is in turn connected to an interconnecting transmission system 25.

The shaft means 23 is orientated to the straight track member 11 so that the straight lift piece 18 moves upwardly from straight track member 11 and the cut-out portion 17 therein when the straight lift piece 18 moves from seated to raised position, thereby assuring that it clears movement of the curved lift piece 20 when the latter moves into seated position.

The curved track includes generally the same elements, i.e., a curved lift piece, an actuating arm, a tubular hub member, a shaft means, and a crank arm connected to the interconnecting transmission system 25, all of which function in the corresponding manner.

In this particular embodiment, when the downward force is applied to the crank arm 24, the tubular hub member 22 rotates in a clockwise direction, thereby simultaneously moving the actuating arm 21 in a vertical or upward direction which simultaneously moves the straight lift piece 18 into a non-trolley engageable position. The part of the switching mechanism on the curved track simultaneously operates in the opposite fashion or in a counterclockwise direction, thereby moving the curved lift piece 20 into a seated or trolley engageable position.

Figure 2:
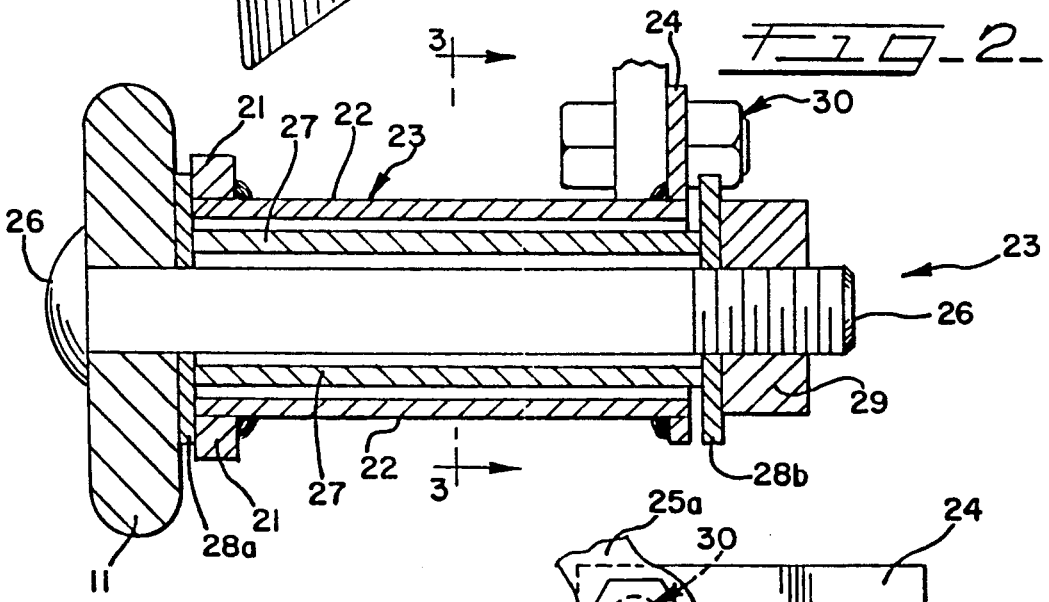
FIG. 2 is a longitudinal cross-sectional view of the pivot and shaft means taken substantially along line 2—2 of FIG. 1.
Figure 3:
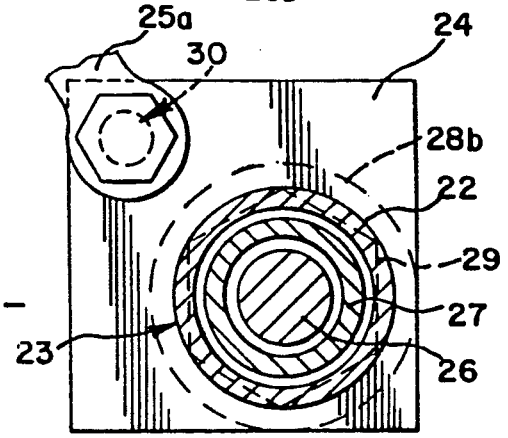
FIG. 3 is an axial cross-sectional view of the pivot and shaft means taken substantially along line 3—3 of FIG. 2.

The unique and improved pivot and shaft means for the switch is shown in detail in FIGS. 2 and 3. The shaft means 23 has a cylindrical inner or center shaft 26 and a hollow cylindrical outer shaft or sleeve 27. Inner shaft 26, in the preferred embodiment, is in the form of a threaded bolt which is secured through the straight track member 11. Outer shaft 27, preferably shorter than the inner shaft 26, fits over the inner shaft 26 and its inner end abuts against a round washer **28*a* which functions as a spacer between actuating arm 21 and the straight track member 11. Tubular hub member 22, which is shorter than the outer shaft 27 by about one-sixteenth of an inch, is placed over the outer shaft 27 in pivotal engagement therewith. The tubular hub member 22 is secured to the actuating arm 21 on one end and the crank arm 24 on the opposite end. The outer shaft 27 is fastened to the straight track by a round washer 28*b* of greater diameter than the outer shaft 27 and of equal or greater diameter than the hub member 22, and a self-locking nut 29 is threadedly fastened on the inner shaft 26 such that the round washer 28*b* abuts against the outer end of the outer shaft 27. The round washer 28*b* and self-locking nut 29 thereby effectively secure the outer shaft 27 to the straight track member 11. Furthermore, the round washer 28*b* and self-locking nut 29 prevent the tubular hub member 22 from dislodging from the outer shaft 27. The tubular hub member 22, being of shorter length than the outer shaft 27, freely rotates about the outer shaft 27, as there is a clearance allowed between the washer 28*b* and the end of the hub member. The force of the free rotation necessary for switch means 10 is not transferred to the inner shaft 26 nor the washer 28 and the self-locking nut 29**, whereby the shaft means needs little, if any, adjustment during the normal operation of the overhead track system. The shaft means will not tend to loosen upon repeated pivotal operation of the lift piece hub member, and the tension in the pivot will be preloaded by the length of the outer shaft or sleeve.

The length of the outer shaft or sleeve 27 as it relates to the hub member length determines the fit between the washer 28*b* and the adjacent hub end and the rotational tension of the lift piece, thereby presetting that tension. A shorter sleeve increases the tension, while a longer sleeve decreases the tension. When the nut is tightened on the inner shaft, the tension will therefore be preset or preloaded.

The unique pivot and shaft means for the switch is also shown in FIG. 3. FIG. 3 shows the relationship between the solid cylindrical inner shaft 26, the hollow cylindrical outer shaft 27, and the tubular hub member 29. FIG. 3 also shows washer 28*b* in a circular dotted line to be of greater diameter than the tubular hub member 22, and self-locking nut 29 in a hexagonal dotted line, which is fastened on the inner shaft 26 and secures the washer 28*b* in place. A link 25*a* is pivotally connected to the crank arm 24 of the tubular hub member 22 by a nut and bolt assembly 30, and link 25*a* is in turn pivotally connected to a rocker lever or bar 25*c* of the interconnecting transmission system 25. The hub of the curved lift section is pivotally connected by a link 25*b* to the transmission system 25, and the link 25*b* is pivotally connected to a rocker bar 25*c*.

While this type of pivot and shaft means has been used before in other unrelated mechanisms, it has never been used in overhead track switching systems. While many different switching mechanisms have been developed, none have used a pivot and shaft means characteristic of the present invention. This pivot and shaft means provides a better overhead track switching mechanism which is easily installed to have a preloaded pivot and is not affected by the pivoting of the hub member such that it needs little, if any, maintenance, and which may be easily serviced in the field.

It is therefore appreciated that the track switch of the present invention with its unique pivot and shaft means is substantially superior to the switches heretofore known because it is easily installed to the proper preset tension, needs little, if any, adjustment, and may be easily maintained and serviced.

It will be understood that modifications and variations may be effected without departing from the scope of the novel concepts of the present invention, but it is understood that this application is to be limited only by the scope of the appended claims.

The invention is hereby claimed as follows:

1. In combination with an overhead trolley track system having a plurality of tracks adapted to movably support a plurality of trolleys, a switch for a pair of intersecting tracks for controlling trolley movement between the tracks which comprises, first and second track members, bridge means for interconnecting and supporting said track members in juxtaposed space relation, a track lift piece for each said track member, said lift pieces being mounted to be alternately movable between a first non-trolley engageable raised position and a second trolley engageable seated position to allow trolley movement through the switch on the track member having the lift piece in seated position, a shaft means extending form each of the track members, each shaft means having an inner and an outer shaft, each outer shaft fitting over each inner shaft, a fastening means on each inner shaft securing each outer shaft to said track member, a hub member pivotally supported on each outer shaft and being shorter than each outer shaft, said lift pieces being connected to and supported by said hub members, whereby the hub members freely pivot on the shaft means and such free pivotal movement is assured by virtue of each outer shaft having a greater length then the hub member.

2. The switch as defined in claim 1, wherein each outer shaft is of hollow construction and cylindrical form.

3. The switch as defined in claim 1, wherein each inner shaft is a bolt.

4. The switch as defined in claim 3, wherein each bolt is threaded and wherein the fastening means is a washer and a lock nut.

5. The switch as defined in claim 1, wherein each hub member is about one sixteenth of an inch shorter than each outer shaft.

6. The switch as defined in claim 1, wherein a spacer is mounted on each inner shaft between said track member and each outer shaft to space the hub member from the track member.

7. A switching unit for overhead tracks adapted to have trolleys movable therealong, said unit comprising, a first track member and a second track member in intersecting relation with the first track member, one of the track members having an upper section cut away to form a recess, the other track member having its free end in spaced relation from the said one track member, each track member having a shaft means, a switching element for each of said track members, each switching element having a hub member received by the respective shaft means, each said shaft means having an inner shaft and an outer hollow shaft fastened to said track members, each hub member being pivotally received on each outer shaft, washer means at each end of each outer shaft limiting the lateral movement of each hub member, fastening means on each inner shaft for locking the washer means and each outer shaft together, and each outer shaft being longer than each hub member such as to preset the rotational tension on the hub member.

8. In a track switch for interacting tracks of an overhead trolley track system including pivotally mounted lift pieces on the intersecting tracks, wherein the lift pieces have hub members pivotally received on shaft means, the improvement in the shaft means for the hub members each of which comprise, a fixed center shaft extending from the track adjacent to the lift piece, a spacer on said center shaft contacting the track, a sleeve received on the center shaft bearing against the spacer next to the track at one end and terminating inward from the end of the center shaft at the other end, said hub member being pivotally received on the sleeve, and means on the outer end of the center shaft retaining the hub member on the sleeve and securing said sleeve to the track, whereby the rotary tension of the hub member is preset by the length of said sleeve.

9. The shaft means of claim 8, wherein the hub member retaining means includes a washer received on the shaft.

10. The shaft means of claim 9, wherein the sleeve securing means includes a nut threadedly received on the shaft.

11. The shaft means of claim 10, wherein the spacer includes a washer on said center shaft.

* * * * *